US005399069A

United States Patent [19]

Marey et al.

[11] Patent Number: 5,399,069

[45] Date of Patent: Mar. 21, 1995

[54] VANE EXTREMITY LOCKING SYSTEM

[75] Inventors: Daniel J. Marey, Soisy Sur Seine; Thierry J. M. Niclot, Chilly Mazarin; Jean-Jacques R. A. Orsini, Viry Chatillon, all of France

[73] Assignee: Societe Nationale D'Etude et de Construction de Moteurs D'Aviation "SNECMA", Paris, France

[21] Appl. No.: 139,826

[22] Filed: Oct. 22, 1993

[30] Foreign Application Priority Data

Oct. 28, 1992 [FR] France ..... 92.12799

[51] Int. Cl.[6] ..... F01D 9/02

[52] U.S. Cl. ..... 415/209.3; 415/189; 416/220 R

[58] Field of Search ..... 415/189, 190, 209.3, 415/209.4, 210.1, 173.7, 174.4; 416/220 R

[56] References Cited

U.S. PATENT DOCUMENTS 2,812,159 11/1957 Krebs ..... 415/173.7
4,474,535 10/1984 Dhuic ..... 416/220 R
4,655,682 4/1987 Kunz et al. ..... 415/209.4

FOREIGN PATENT DOCUMENTS 0334794 9/1989 European Pat. Off. .
1542561 10/1968 France .
2192243 8/1974 France .
2330276 5/1977 France .
2671140 3/1992 France .
748912 5/1956 United Kingdom ..... 416/220 R

*Primary Examiner*—Edward K. Look
*Assistant Examiner*—James A. Larson
*Attorney, Agent, or Firm*—Oblon, Spivak, McClelland, Maier & Neustadt

[57] ABSTRACT

A system for locking the radial extremity of vanes, wherein the extremities include heels situated behind a ring for delimiting the flow of gases, the heels including hooks between which extend other hooks of the ring. Bolts are disposed in the notches of both types of hooks and fasteners are used to secure the bolts. The assembly obtained is compact, rigid and able to be embodied easily and effectively. It is also virtually free of clearances and vibrations.

22 Claims, 4 Drawing Sheets

VANE EXTREMITY LOCKING SYSTEM

BACKGROUND OF THE INVENTION

1. Field of the Invention

The invention concerns a vane extremity locking system.

2. Discussion of the Background

Turbo-engines include a certain number of vane stages, each stage possessing one radial extremity rigidly attached to the rotor or stator, and one opposing extremity bearing a ring whose main function is to delimit the longitudinal vein or path for the flow of gases. Thus, it is necessary to provide means to accurately and safely connect the ring to the extremities of the vanes to limit clearances and vibrations.

The U.S. Pat. No. 2,812,159 describes a technical solution where the ring is provided with holes allowing for passage of the extremities of the vanes. On the side of the ring opposite the vein, springs in the shape of folded back plates are disposed around the extremities of the vanes and pins traverse perforations situated at the end of the extremities so that the springs are compressed between the ring and the pins. It then becomes impossible to extract the vane extremities from the ring. As the vanes widen at the step on the side of the flow vein, it is no longer possible to drive them inside the ring. The springs are unable to slide over the ring as they fully surround the vane extremities, and finally the pins are retained in the reinforcements of the springs. Any accidental movement likely to disconnect the elements of the system is thus excluded. However, it is possible that in this technique vibrations do not appear during operation as the assemblies obtained are not particularly rigid. If it is intended to combat this drawback by using a more rigid spring, mounting shall be more difficult and it shall be necessary to overcome a higher spring elasticity force so as to be able to place the pins, this proving to be more awkward when the pins are introduced tangentially to the springs, that is with less space to work with.

SUMMARY OF THE INVENTION

The invention has been designed to be able to better satisfy the qualities required for the system and mentioned above. It is characterized in that the extremities of the vanes include at least one hook, the ring includes at least one hook close to each hole, the hooks of the ring being contiguous-with the hooks of the extremities and along with the latter forming groups of hooks, each group being associated with one vane, and the locking means include inserts, each insert being housed in the hooks of one of the groups, as well as stoppage means which retain the inserts in the hooks. This results in obtaining accurate and robust assemblies less subject to vibrations.

The stoppage means may include an elastomer coating cast onto the inserts and hooks, the main function of said coating being to reduce vibrations. Said means may also include elements connecting the hooks to the inserts and which are put into position via a radial movement by means of pegs, pliers or fasteners.

Certain dispositions of the hooks benefit the quality and coherence of the assembly. Thus, longitudinal orientation hooks are recommended, each extremity including one pair of hooks with one hook being orientated opposite the other. The inserts housed in the hooks of a pair may then be connected by a rigid bridge.

This disposition prohibits any longitudinal movement of the inserts in the hooks.

If a hook of each group is connected to a hook of another set by means of a rigid bridge so that the bridges of hooks are superimposed on the bridges of inserts in a radial direction, the elements connecting the hooks to the inserts may assume the shape of elastic fasteners surrounding the bridges of inserts and disposed around the hook bridges. A simple radial movement of the fasteners suffices to ensure locking effected extremely easily as the bridges are properly disengaged.

BRIEF DESCRIPTION OF THE DRAWINGS

There now follows a detailed description of the invention with reference to the accompanying figures given by way of illustration and being non-restrictive.

DESCRIPTION OF THE PREFERRED EMBODIMENTS

Figure 1:
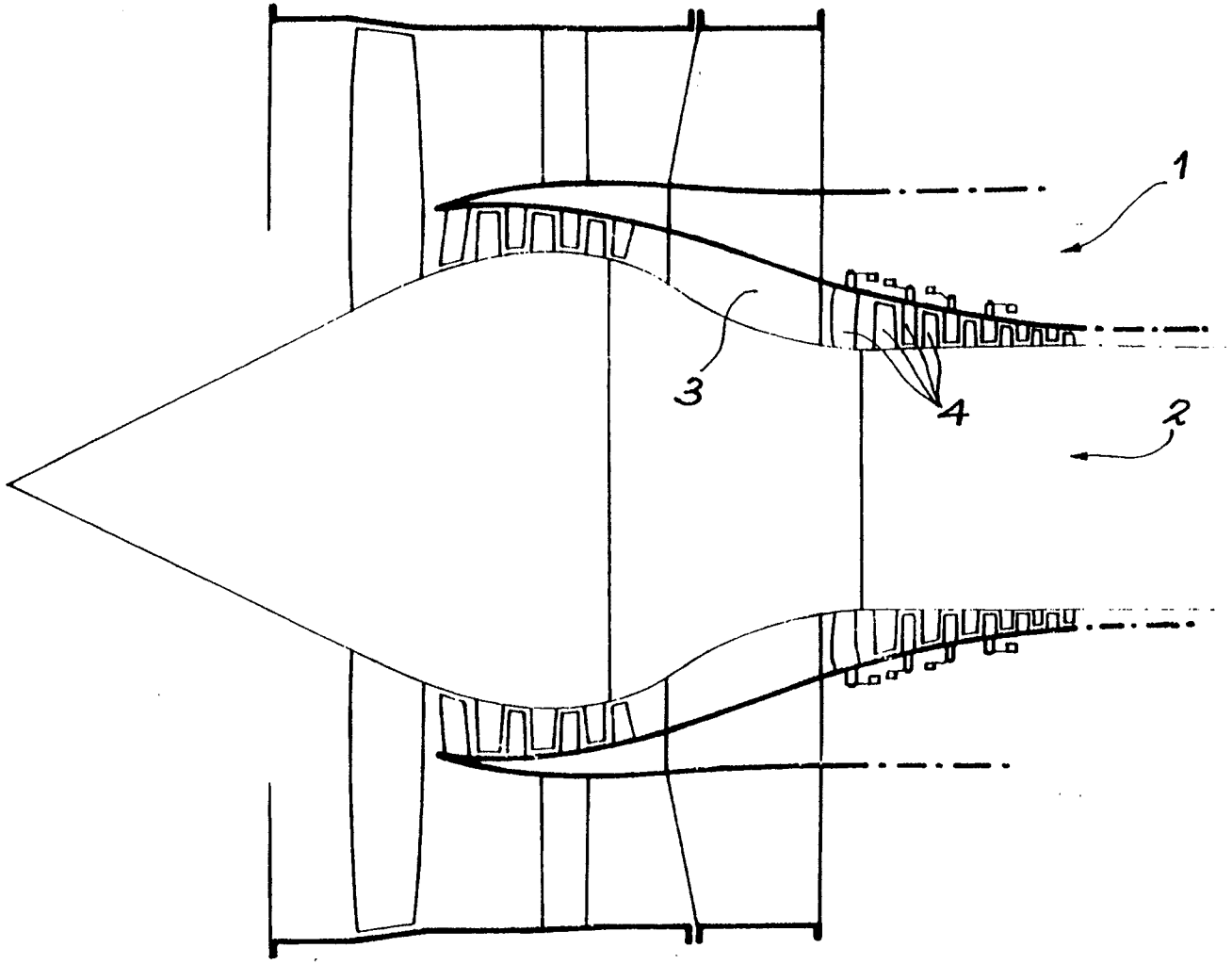
FIG. 1 shows a general view of a turbo-engine.

The engine of FIG. 1 conventionally includes a stator 1 which surrounds a rotor 2 and thus delimiting with the latter a gas flow vein 3 orientated longitudinally, that is along the axis of the engine.

The vein 3 is provided with a certain number of vane stages 4 which belong to turbines or compressors ; the stages connected to the rotor 2 alternate with the diffusing stages connected to the stator 1 and the invention shall be now described for the vanes 4 of this latter category of stages without it being possible to eliminate the use of the locking system for the vanes 4 attached to the rotor 2.

Figure 2:
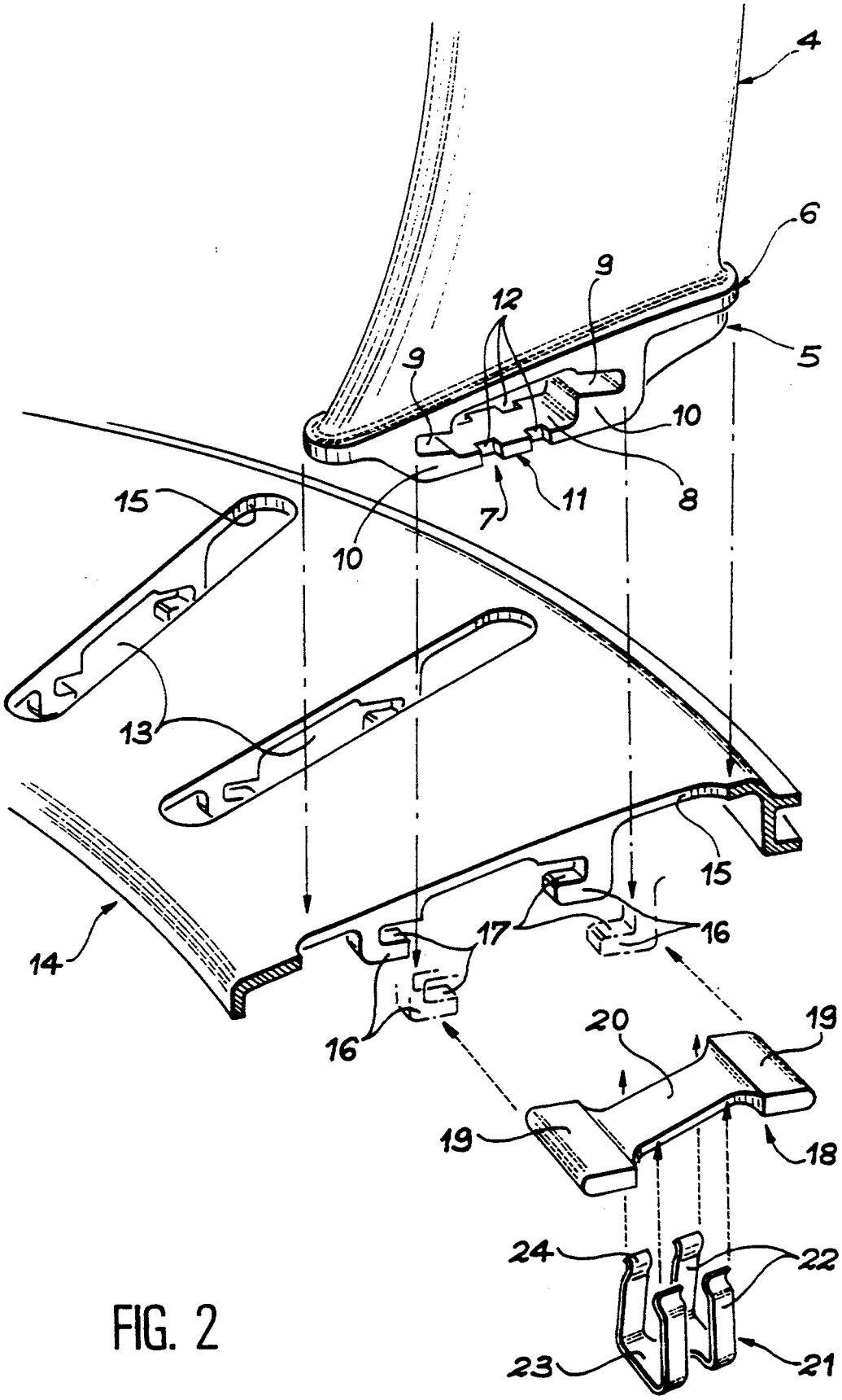
FIG. 2 is an exploded perspective view of the main elements of the system.
Figure 3:
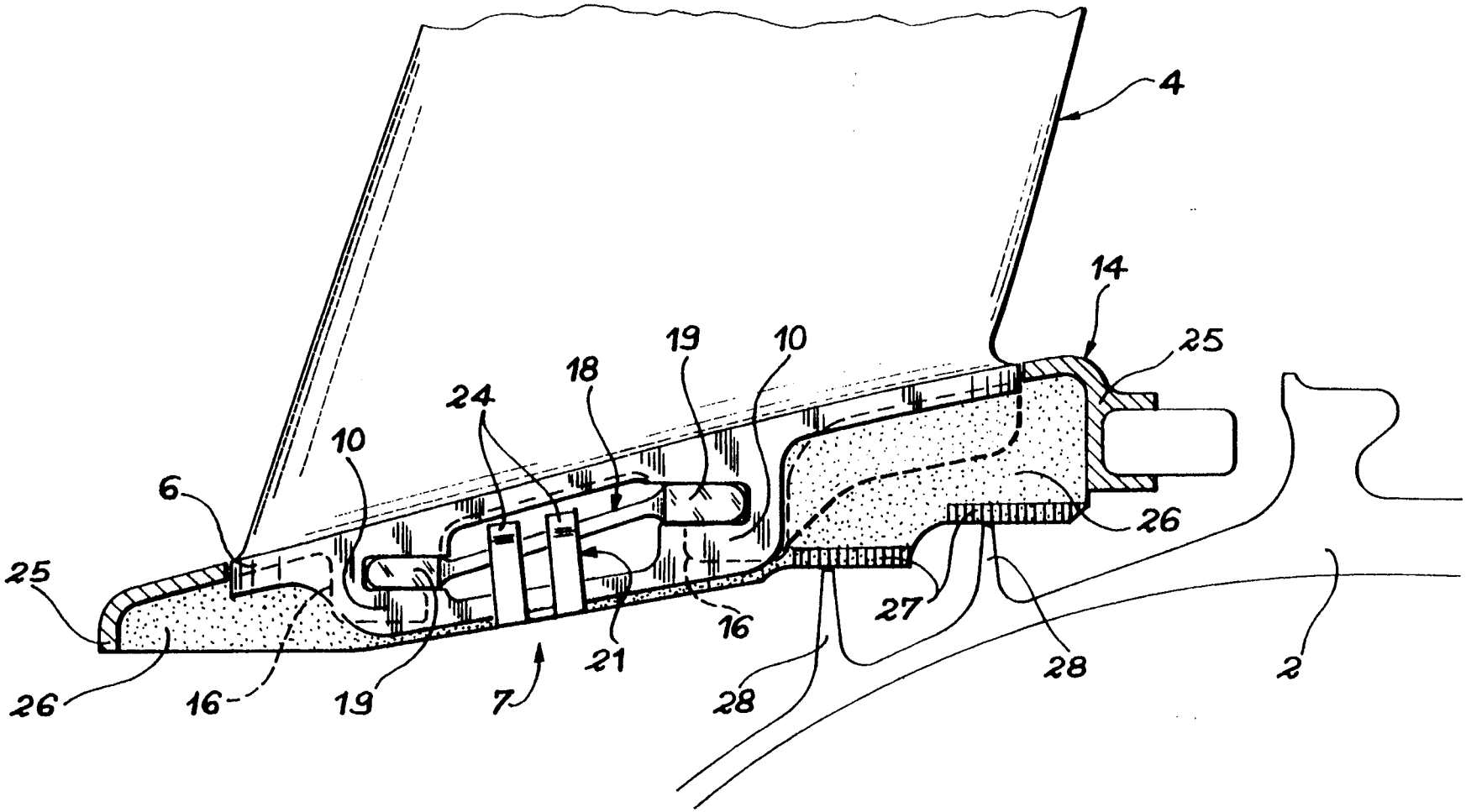
FIG. 3 is a longitudinal section of the assembled elements of the system.
Figure 4:
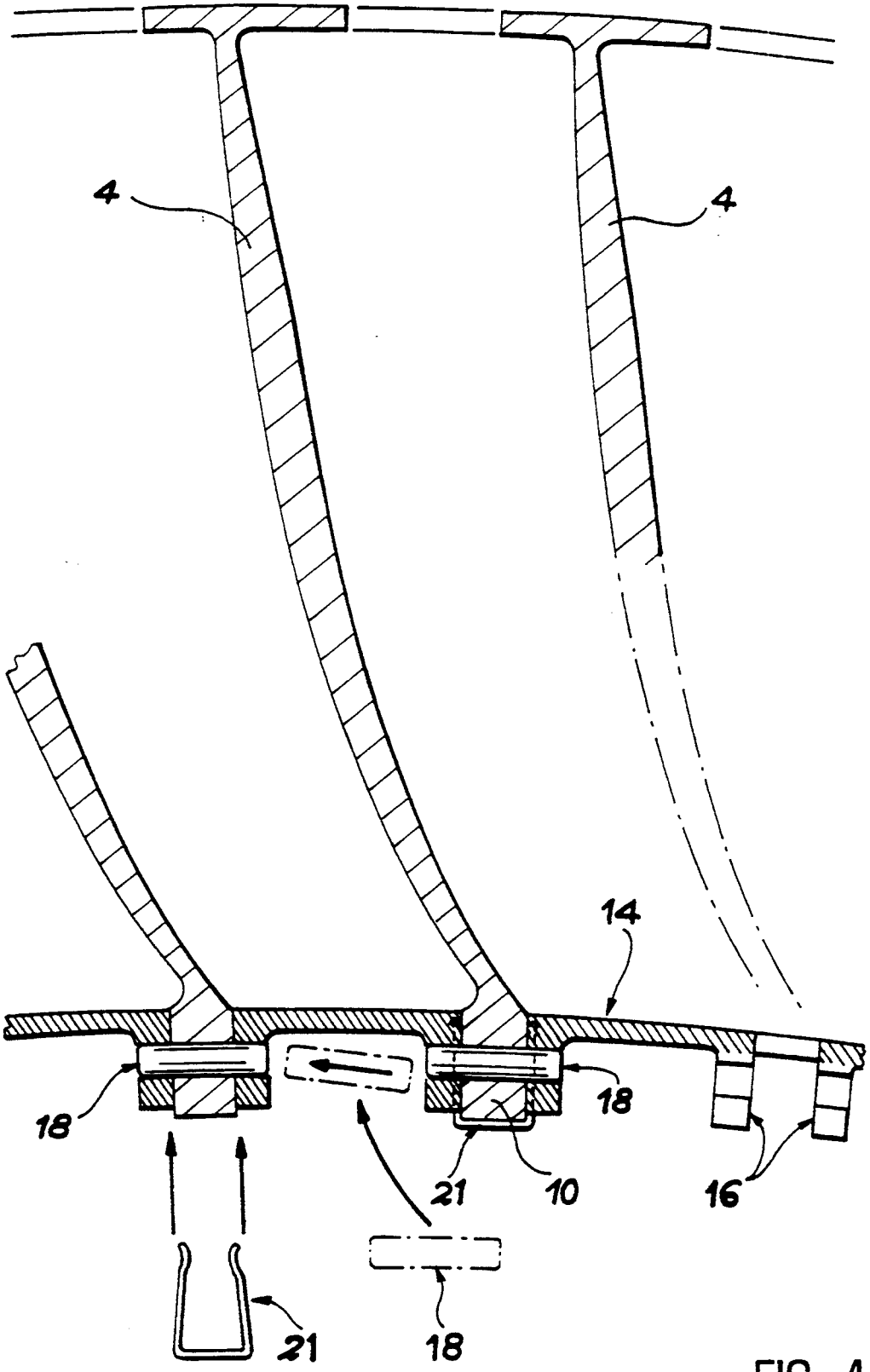
FIG. 4 is a cross section of the assembled elements of the system.

The vane 4 shown in FIGS. 2 to 4 is thus connected at its external extremity to the stator 1 and its internal extremity 5 includes an oblong plunged boss 6 and which extends towards the inside over one portion of the width of the vane 4 by a heel 7 traversed by a complex-shaped hole 8. It is formed of two notches 9 connected by a widened portion and the portions of the heel 7 situated around the notches 9 form two hooks 10 orientated longitudinally and in opposing directions and situated opposite each other, and the extremities of the hooks 10 are interconnected by a rigid bridge 11 with each of its edges being notched with a pair of steps 12. The plunged boss 6 is provided so as to be overlapped with a small amount of play in one of the recesses 13 of a ring 14 delimiting the vein 3. When mounting has been embodied, the heel of the vane 4 projects onto the face opposite the vein 3 of the ring 14 and each of the hooks 10 of the vane extremity is framed by a pair of ring hooks 16 situated on the two sides of the recess 13: the hooks 10 and 16 associated with each vane 4 constitute two groups, each group being formed of one vane hook 10 and one pair of ring hooks 16. The hooks 10 and 16 of a given group all have the same shape so that the notches 17 of the ring hooks extend the notch 9 of the vane hook 10 in a direction tangential to the ring 14.

It is therefore possible to slide a bolt 18 into the notches 9 and notches 17 so as to lock the vane 4 on the ring 14. The bolt 18 is formed of two inserts 19 which fully occupy the notches 9 and 17 of the two groups of hooks and which are interconnected by a rigid bridge 20. The rigidity of the bolt 18 and the almost total absence of clearances virtually eliminate vibrations during operation and the disconnecting of the elements may only be effected following a contrary movement of the bolt 18 in a tangential direction. So as to avoid this possibility, the locking system further includes an elastic fastener composed of two pairs of branches 22 connected by a crosspiece 23 and provided with one rounded free extremity 24. The fastener 21 is put into position via a radial movement towards the outside, the branches 22 sliding into the steps 12 until the crosspiece 23 touches the bridge 11. It is then necessary that the rounded extremities 24 are made to pass beyond the bridge 20 which has spaced them, after which the branches 22 can be brought together again. In this situation, the bolt 18 is locked and only a deliberate action is thus able to extract the fastener 21.

In FIG. 3, it can be seen that the ring 14 is provided with two circular edges 25 which surround the heel 7 and delimit a hollow circular space which may be filled with an elastomer coating 26 whose main function is to further dampen the vibrations of the locking system, one of its other functions being to render impossible any accidental dislodging of the fasteners 21 as they are embedded in the elastomer. Glueing of the inserts 19 to the hooks 10 and 16 is also obtained by means of the elastomer. Finally, the coating 26 possesses an internal free surface orientated towards the rotor 2 and which may be lined with layers 27 made of an easy erosion material and known as an "abradable" in this technique. This is used to provide imperviousness between the ring 14 and the rotor 2 by cooperating with raised up circular sealing lips 28 on the rotor 2. The lips 28 rub on the layers 27 and destroy them at the contact locations but only permit an extremely small clearance.

The invention can be embodied in other forms with the hooks 10 and 16 distributed in a different fashion or with different stoppage means. The fasteners could possibly be replaced by pliers, pegs or similar elements made of an elastic material and placed in such a way so that the deformations they undergo prohibit them from being dismantled from the assembly. It is possible to use elastic pegs with a slit tube-shaped section driven into the perforations of the hooks and the inserts. The solution described is advantageous as it involves a single locking element and a single stoppage element for a large number of hooks, that is it allows for extremely easy dismantlings and good behavior of the assembly.

What is claimed is:

1. A system for locking radial extremities of vanes for a stage disposed in a longitudinal flow path, which comprises:

a ring which delimits the flow path and which is provided with a plurality of recesses for radial passage of the extremities of the vanes upon radial movement of the vane extremities therethrough;

means for locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter groups of hooks, each of the groups of hooks being located in proximity with one of the vanes, and wherein the locking means include rigid inserts, each said insert being housed in one of the groups of hooks, and stoppage means, spaced from the recesses in the ring for respectively retaining the inserts in the groups of hooks.

2. A system for locking radial extremities of vanes for a stage disposed in a longitudinal flow path, which comprises:

a ring which delimits the flow path and which is provided with a plurality of recesses for radial passage of the extremities of the vanes therethrough;

means for locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter a group of hooks, each of the groups of hooks being located in the proximity with one of the vanes, and wherein the locking means include rigid inserts, each insert being housed in one of the groups of hooks, and stoppage means for respectively retaining one of the inserts in the groups of hooks wherein the stoppage means comprises a coating cast onto the inserts and the groups of hooks.

3. A system according to claim 2, which comprises a rotor having at least one sealing lip wherein the coating includes a layer made of an abradable material on one free surface of the coating directed towards said sealing lip.

4. A system for locking radial extremities of vanes for a stage disposed in a longitudinal flow path, which comprises:

a ring which delimits the flow path and which is provided with a plurality of recesses for radial passage of the extremities of the vanes therethrough;

means for locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter a plurality of groups of hooks, each of the groups of hooks being located in proximity with one of the vanes, and wherein the locking means includes rigid inserts, each of said inserts being respectively housed in one of the groups of hooks, and stoppage means for respectively retaining one of the inserts in the groups of hooks wherein the stoppage means include means for connecting the hooks to each of the inserts and wherein said connecting means are positioned by radial movement thereof.

5. A system according to claim 4, wherein the means for connecting the hooks to the inserts comprise fasteners.

6. A system according to claim 5, wherein adjacent groups of said groups of hooks each include one pair of hooks with one hook orientated opposite the other, and wherein a first rigid bridge interconnects adjacent inserts.

7. A system according to claim 6, wherein in each group of hooks a first hook of a first group is connected to a second hook of a second group by a second rigid bridge, wherein the bridges of the groups of hooks are respectively superimposed on the bridges of the inserts in a radial direction.

8. A system according to claim 7, wherein the fasteners surround the bridge of the insert.

9. A system for locking radial extremities of vanes for a stage disposed in a longitudinal flow path, which comprises:

a ring which delimits the flow path and which is provided with a plurality of recesses for radial passage of the extremities of the vanes therethrough;

means for locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter a plurality of groups of hooks, each of the groups of hooks being located in proximity with one of the vanes, and wherein the locking means includes inserts, each insert being housed in one of the groups of hooks, and stoppage means, for retaining one of the inserts in the group of hooks wherein the hooks have a longitudinal orientation.

10. A system according to claim 9, wherein each group of hooks comprises a first vane extremity hook and a pair of ring hooks situated on both sides of said first vane extremity hook.

11. A system according to claim 9, wherein each of the groups of hooks includes a pair of hooks with one hook orientated opposite the other, and a rigid bridge which interconnects opposite ends of each insert and wherein the inserts housed in the hooks of the pair of hooks are connected by said rigid bridge.

12. A system for locking radial extremities of vanes for a stage disposed in a longitudinal flow path, which comprises:

a ring which delimits the flow path and which is provided with a plurality of recesses for radial passage of the extremities of the vanes upon radial movement of the vane extremities therethrough; and a locking mechanism locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter a group of hooks, each group of hooks being located in proximity with one of the vanes, and wherein the locking mechanism includes rigid inserts, each insert being housed in one of the groups of hooks, and respectively a stoppage mechanism spaced from the recesses in the ring for retaining the insert in the group of hooks.

13. A system as claimed in claim 12, wherein the stoppage mechanism includes mechanisms connecting the hooks to the inserts wherein said connecting mechanisms are positioned by radial movement thereof.

14. A system according to claim 13, wherein the elements for connecting the hooks to the inserts comprise fasteners.

15. A system according to claim 14, wherein adjacent groups of said groups of hooks each include one pair of hooks with one hook oriented opposite the other and wherein a first rigid bridge interconnects adjacent inserts.

16. A system according to claim 15, wherein in each group, a first hook of a first group is connected to a second hook of a second group by a second rigid bridge wherein the bridges of the groups of the hooks are respectively superimposed on the bridges of the inserts in a radial direction.

17. A system according to claim 16, wherein the fasteners surround the bridge of each said insert.

18. A system for locking radial extremities of vanes for a stage disposed in a longitudinal flow path, which compirses:

a ring which delimits the flow path and which is provided with a plurality of recesses for passage of the extremities of the vanes;

a locking mechanism locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter a group of hooks, each group of hooks being located in proximity with one of the vanes, and wherein the locking mechanism includes rigid inserts, each insert being housed in one of the groups of hooks, and a stoppage mechanism respectively retaining the insert in the group of hooks wherein the stoppage mechanism comprises a coating cast onto the inserts and the group of hooks.

19. A system according to claim 18, which comprises a rotor having at least one sealing lip wherein the coating includes a layer made of an abradable material on one free surface of the coating directed towards said sealing lip.

20. A system for locking radial extremities of vanes for a stage disposed in a longitudinal flow path, which comprises:

a ring which delimits the flow path and which is provided with a plurality of recesses for passage of the extremities of the vanes therethrough;

a mechanism locking the ring on the vane extremities, the ring including at least one hook positioned in proximity with each of the recesses, wherein the vane extremities each include at least one hook, said at least one hook of the ring being contiguous with the at least one hook of the vane extremities and forming with the latter a group of hooks, each group of hooks being located in proximity with one of the vanes, and wherein the locking mechanism includes rigid inserts, each insert being housed in one of the groups of hooks, and a stoppage mechanism retaining the insert in the group of hooks wherein the hooks have a longitudinal orientation.

21. A system according to claim 20, wherein each group of hooks comprises a first hook and a pair of ring hooks situated on both sides of said first hook.

22. A system according to claim 20, wherein each group of hooks includes a pair of hooks with one hook oriented opposite the other and a rigid bridge which interconnects opposite ends of each insert and wherein the inserts housed in the hooks of the pair of hooks are connected by said rigid bridge.

* * * * *